US009330642B2

(12) United States Patent
Nicholson

(10) Patent No.: US 9,330,642 B2
(45) Date of Patent: May 3, 2016

(54) WEIGHTED, GRIPPING DRUM PILLOW

(71) Applicant: Jon Nicholson, Los Angeles, CA (US)

(72) Inventor: Jon Nicholson, Los Angeles, CA (US)

( * ) Notice: Subject to any disclaimer, the term of this patent is extended or adjusted under 35 U.S.C. 154(b) by 0 days.

(21) Appl. No.: 14/852,130

(22) Filed: Sep. 11, 2015

(65) Prior Publication Data

US 2016/0078852 A1 Mar. 17, 2016

Related U.S. Application Data

(60) Provisional application No. 62/049,805, filed on Sep. 12, 2014, provisional application No. 62/197,411, filed on Jul. 27, 2015.

(51) Int. Cl.
*G10D 13/02* (2006.01)

(52) U.S. Cl.
CPC ..... *G10D 13/022* (2013.01)

(58) Field of Classification Search
CPC ..... G10D 13/022
See application file for complete search history.

(56) References Cited

U.S. PATENT DOCUMENTS 4,338,850 A * 7/1982 Payson ..... G10D 13/022 84/411 M
4,567,807 A 2/1986 Robinson
4,589,323 A 5/1986 Belli et al.
4,671,158 A 6/1987 Saputo
4,745,839 A * 5/1988 Peraino ..... G10D 13/022 84/411 M
4,899,635 A 2/1990 Santangelo
5,088,376 A 2/1992 Crago et al.
5,107,741 A 4/1992 Beals et al.
5,233,898 A * 8/1993 Montano ..... G10D 13/022 181/207
5,363,523 A 11/1994 Blackburn
5,398,583 A 3/1995 Cook
5,581,030 A * 12/1996 Conroy ..... G10D 13/022 84/411 M
5,637,819 A 6/1997 Rogers
5,877,440 A 3/1999 Chaffee et al.
6,043,420 A 3/2000 Arnold
6,291,754 B1 9/2001 Gatzen et al.
6,307,133 B1 10/2001 May et al.
6,573,441 B2 6/2003 Norris, Jr.
6,586,664 B1 * 7/2003 Hubbell ..... G10D 13/022 84/411 M
6,684,429 B1 2/2004 Deering
6,696,630 B2 2/2004 Gatzen
8,148,619 B1 4/2012 May et al.
8,410,345 B2 * 4/2013 Patrick ..... G10D 13/022 84/411 M
8,541,675 B2 9/2013 Strickland
8,759,652 B2 6/2014 Caprarola
8,895,827 B1 11/2014 Grossman
2008/0148921 A1 * 6/2008 Calder ..... G10D 13/022 84/411 M

* cited by examiner

*Primary Examiner* — Robert W Horn

(57) ABSTRACT

The disclosure provides a drum pillow for percussion instruments. In one embodiment, the drum pillow includes: (1) a top side, (2) a bottom gripping side connected to the top side and (3) a weighted core fully enclosed within the connected top side and bottom side, wherein the weighted core includes a weighted roll of a weighted substance within a flexible container that is rolled in a fabric.

7 Claims, 7 Drawing Sheets

WEIGHTED, GRIPPING DRUM PILLOW

CROSS REFERENCE TO RELATED APPLICATIONS

This application claims priority from U.S. Provisional Patent Application No. 62/049,805, filed by Jon Nicholson on Sep. 12, 2014, and U.S. Provisional Patent Application No. 62/197,411 filed by Jon Nicholson on Jul. 27, 2015, both of which are incorporated herein by reference.

TECHNICAL FIELD

This application is directed, in general, to sound muffling and, more specifically, to a device that is used to muffle sound of a drum.

BACKGROUND

For various reasons, including personal preferences or for recording purposes, the heads of drums are often muffled. This has been done in many ways for bass drums by using quilts, blankets, sandbags, and pillows to achieve a desired sound. Some products have even been manufactured for the specific use of muffling the sound of bass drums and other drums, such as snares and toms. Some of these products include fasteners to ensure the muffling product stays in a desired location.

SUMMARY

In one aspect, the disclosure provides a drum pillow for percussion instruments. In one embodiment, the drum pillow includes: (1) a top side, (2) a bottom gripping side connected to the top side and (3) a weighted core fully enclosed within the connected top side and bottom side, wherein the weighted core includes a weighted roll of a weighted substance within a flexible container that is rolled in a fabric.

BRIEF DESCRIPTION OF THE DRAWINGS

For a more complete understanding of the present disclosure, reference is now made to the following descriptions taken in conjunction with the accompanying drawings, in which.

DETAILED DESCRIPTION

Figure 1:
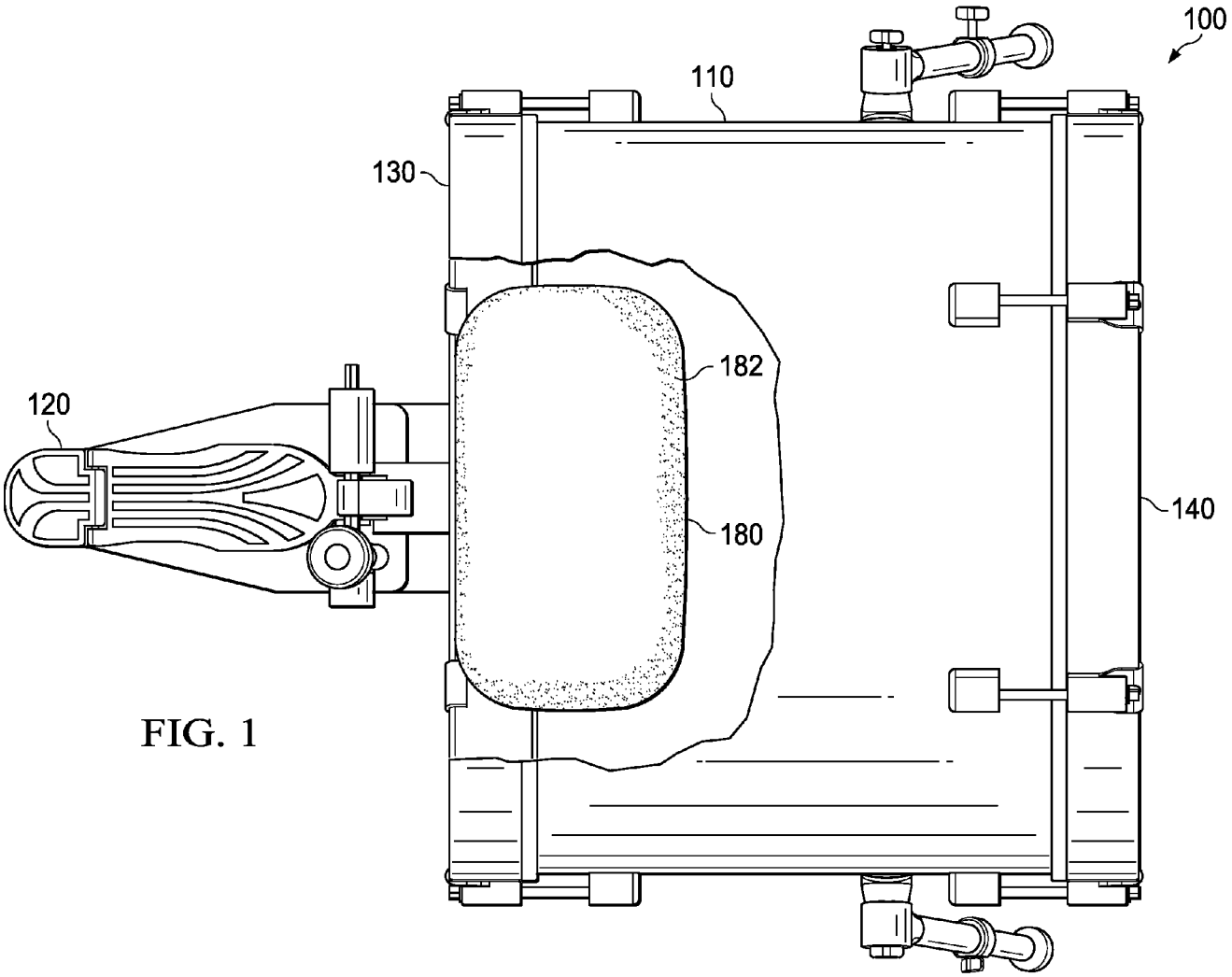
FIG. 1 illustrates a top view of a bass drum and an embodiment of a drum pillow, constructed according to the principles of the disclosure, positioned within the bass drum.

The disclosure provides a muffling product or dampening means that can be used for the acoustic muffling or dampening of percussion instruments, such as drum heads. In one embodiment, the disclosure provides a drum pillow that can be placed on or within a percussion instrument, such as within a bass drum, to achieve improved muffling tone control. The disclosed drum pillow is in the form of a weighted, non-skid, self-stabilizing bass drum pillow. The disclosed drum pillow advantageously combines a weighted interior with a non-skid underside. As such, the disclosed drum pillow provides a dense and more flexible dampening product compared to existing dampening products used with percussion instruments.

The disclosed drum pillow does not require fasteners to maintain placement, with respect to a percussion instrument, but instead relies on the weight and friction of bottom side of the pillow itself to stay where placed. Since the drum pillow does not need adhesives, Velcro or other types of fasteners to keep the pillow in a particular location, the placement possibilities of the drum pillow are less constrained.

In one application, the disclosed drum pillow can be installed within (or inside of) a bass drum and remain where placed; this allows a drummer to feel a firm, weighted dampening effect which allows for greater accuracy and sound control compared to conventional muffling devices. In one embodiment, the drum pillow has a lateral width of 18.25 inches and measures inches longitudinally. The size and weight of the drum pillow, however, can vary depending on the application or personal choice of a percussionist. Different sizes can be used and multiple drum pillows can be used for particular applications. In one embodiment, the dimensions of the drum pillow are such to allow placement of the drum pillow inside a bass drum through a standard hole, such as used for positioning a microphone, in a head of the bass drum. The installed pillow or pillows can be easily manipulated therein through the hole allowing different sounds or feel. As such, the drum pillow allows for more subtlety and flexibility in positioning and muffling control.

In some embodiments the drum pillow or pillows can be used on the external side of a head of a drum. Multiple drum pillows, even of different sizes and/or weight, can be used on the external drum head side or sides and/or within the bass drum. In some embodiments, the drum pillows can be used on both sides of a bass drum head. Thus, a drum pillow can be used within a drum and outside of a drum. As with a bass drum, the drum pillow could be used on the outside and/or the inside of the other drums or percussion instruments, such as snares, toms, cymbals, etc.

In some embodiments, the drum pillow has multiple chambers that are divided by hinges that connect the weighted chambers together. For example, the drum pillow can have two chambers that are connected by a hinge. The hinged drum pillow can then be bent along the hinge and positioned in multiple positions on percussion instruments. The hinge can be placed on the rim of a snare drum or tom wherein one weighted chamber is on the top of the drum (i.e., sitting on the head of the drum) and the other weighted chamber is hanging down the side of the drum at about a ninety degree angle. Additionally, the drum pillow can be placed around the pole or rod of a cymbal using the hinge or even around a support of a foot pedal of a bass drum.

These and other objects and advantages of the disclosure, as well as the details of an illustrative embodiment, will be more fully understood from the following specification and drawings.

Turning now to FIG. 1, illustrated is a top view of a bass drum 100 and an embodiment of a drum pillow 180, constructed according to the principles of the disclosure, positioned within the bass drum 100. The bass drum 100 includes a frame 110, a pedal 120, a first head 130 and a second head 140. The drum pillow 180 engages laterally and longitudinally in its lengthwise condition with the inner side of the first head 130 of the bass drum 100. The drum pillow 180 includes a top side 182 and a dense weighted core (not visible in FIG. 1). The weighted core may include a fleece material for malleability and density, and a weighted substance such as sand for weight. The drum pillow 180 also includes a non-skid fabric underside or bottom side (not visible in FIG. 1) that assists in holding the drum pillow 180 in place on the bottom of the drum and against the first head 130. The non-skid fabric underside can be non-skid or gripping rubberized fabric material for drum pillow stability. The drum pillow 180 may be made in different sizes for an increased or decreased level of attenuation and functionality.

The drum pillow 180 does not have or require a fastening device to hold the drum pillow 180 in place; especially when the pedal 120 is striking the first head 130. Thus, there is no need for corresponding attachment devices on the bass drum 100 and the drum pillow 180. Instead, the disclosed drum pillow 180 provides a simple, efficient muffling product that can be easily installed, removed and adjusted within the bass drum 100. In some embodiments, the drum pillow 180 can be positioned external to the frame of the bass drum 100 (i.e., outside of the bass drum 100) against the outer surface of the first head 130 or the second head 140. Though a bass drum is illustrated, as noted above, the drum pillow can be used with other drums or percussion instruments, also.

Figure 2:
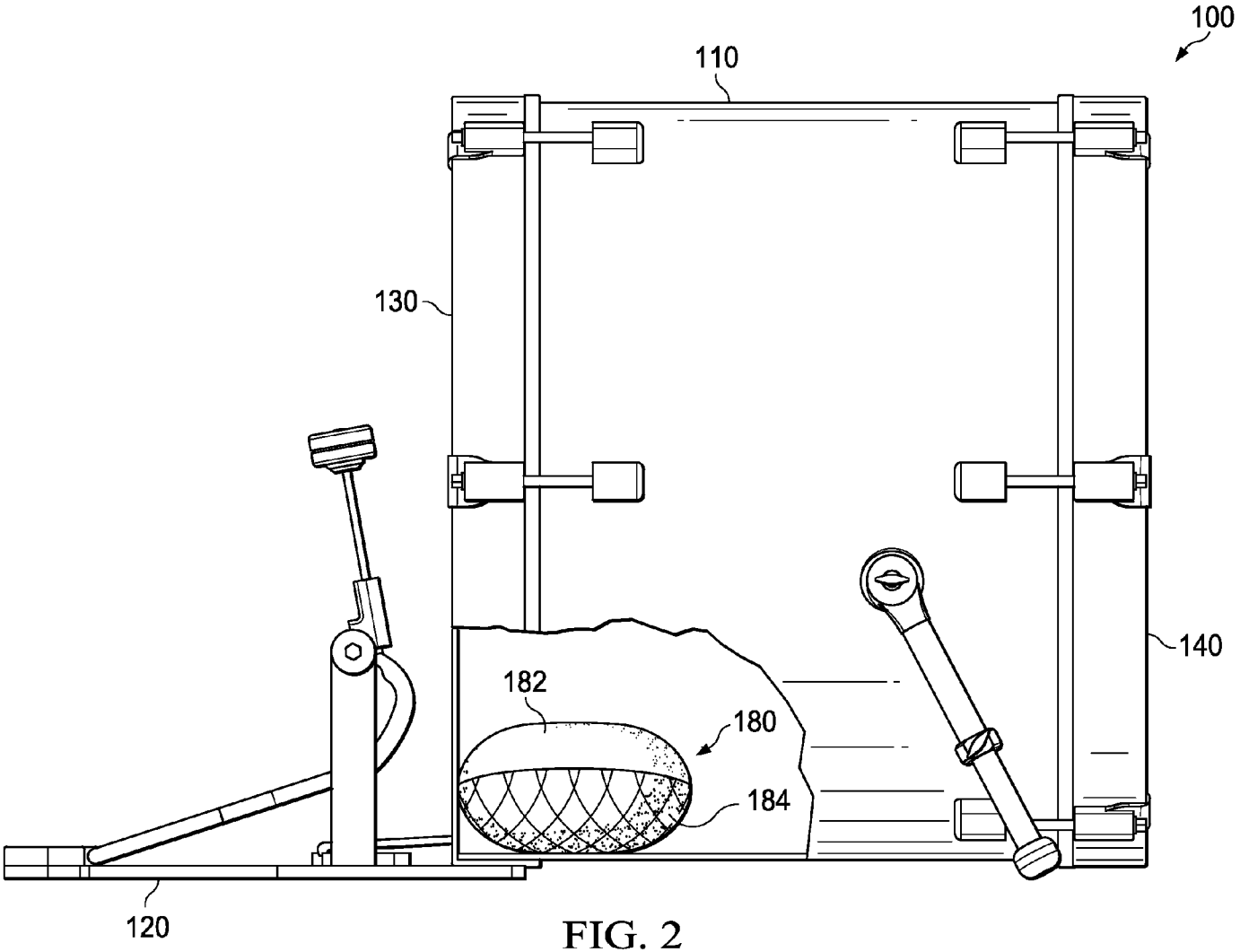
FIG. 2 illustrates a side view of the bass drum of FIG. 1 with the drum pillow positioned against the inner surface of the first head.

FIG. 2 illustrates a side view of the bass drum 100 with the drum pillow 180 positioned against the inner surface of the first head 130. In this view, a top side 182 and a bottom side 154 of the drum pillow 180 are visible. The top side 182 is constructed of a material that is an acoustic absorber. As such, the top side 182 can absorb the energy of sound waves within the bass drum 100. The type of material can vary and can be based on particular sound waves to absorb. As such, the type of pedal, bass drum, head, etc., can determine the type of material to use. In one embodiment, the bottom side 184 is constructed of a gripping material that has a friction surface to prevent slippage. In some embodiments, an entirety of the bottom side 184 is not constructed of a gripping material. In such embodiments, the bottom side 184 can have strips or areas of gripping material that are sufficiently placed on the bottom side 184 to provide friction against surfaces of percussion instruments. For example, the bottom side 184 can have anti-skid or non-slip tape applied to provide a gripping bottom side.

Figure 3:
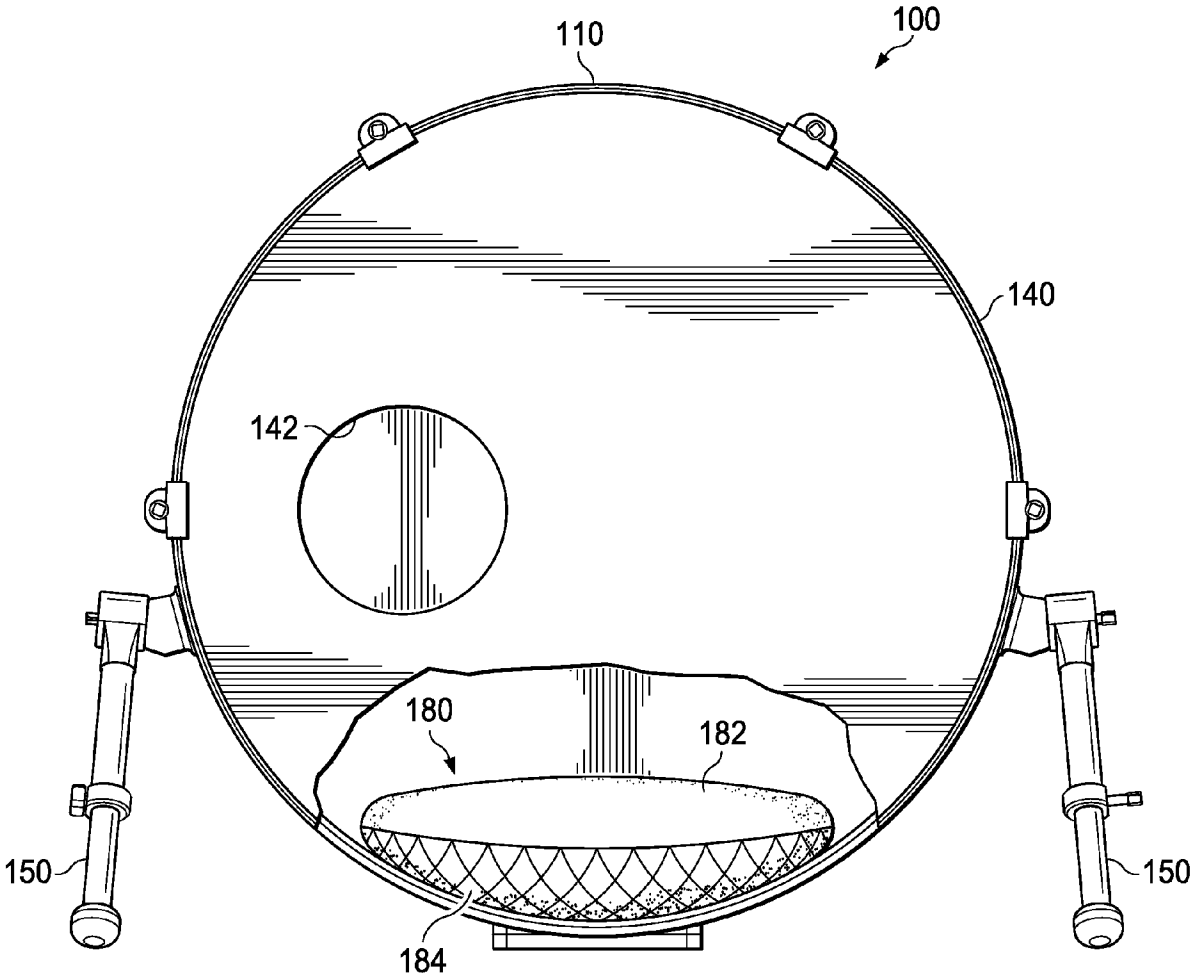
FIG. 3 illustrates a back view of the bass drum of FIG. 1 and the drum pillow positioned within the bass drum.

FIG. 3 illustrates a back view of the bass drum 100 and the drum pillow 180 positioned within the bass drum 100. A hole 142 in the second head 140 is also shown in which the drum pillow 180 can be placed and moved. The hole 142 is a conventional sized hole that is typically used to position a microphone and is located on the head opposite the drum pedal. In FIG. 3, stabilizers 150 are also shown that keep the bass drum 100 in place when being played.

Figure 4:
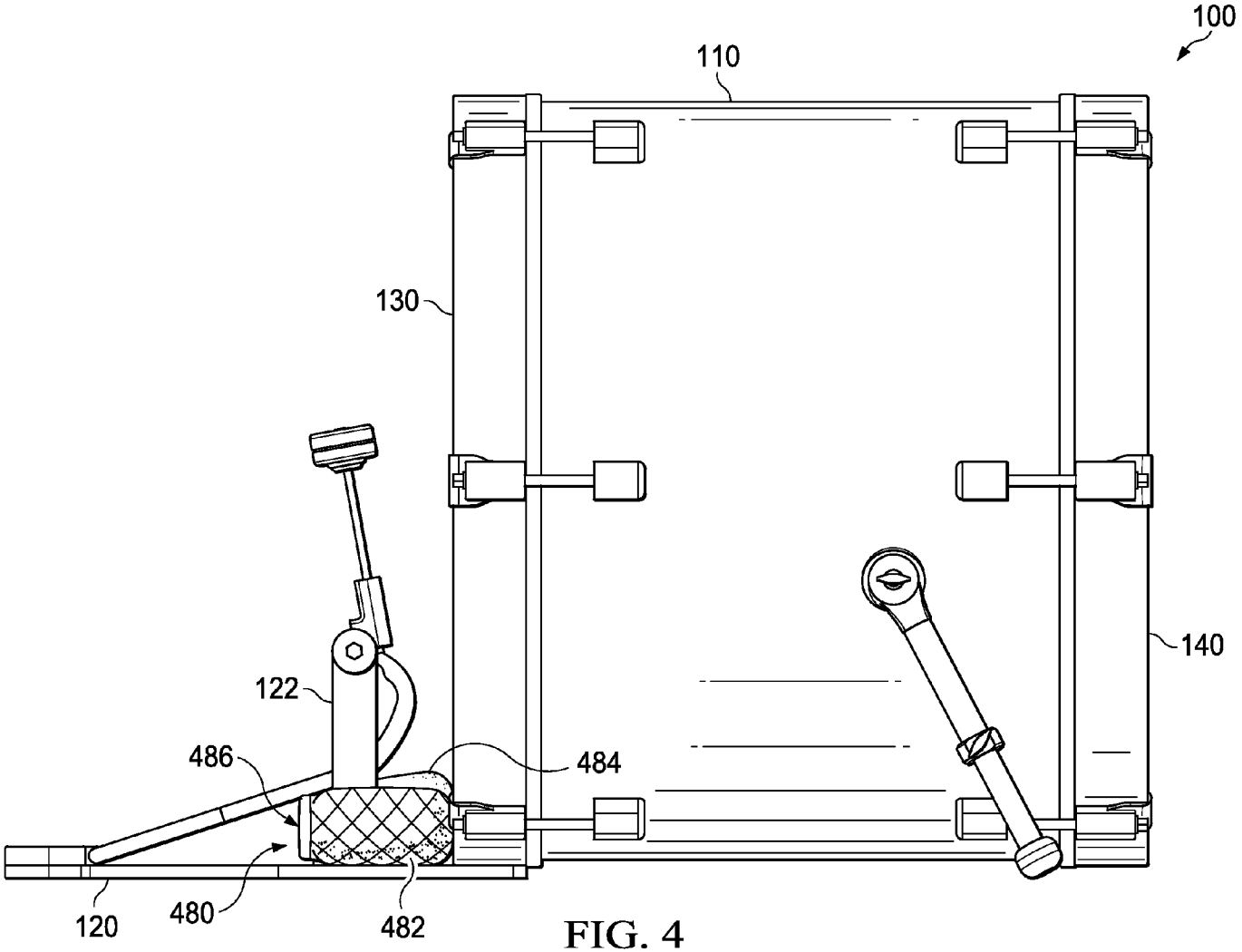
FIG. 4 illustrates a front view of a bass drum and a hinged embodiment of a drum pillow having two weighted compartments and a hinge.

FIG. 4 illustrates a front view of the bass drum 150 and a hinged embodiment of a drum pillow 480 having two weighted compartments 482, 484, and a hinge 486. The drum pillow 480 is positioned around a support 122 of the pedal 120. In this embodiment, the ends of each weighted compartment 482, 484, are positioned against the outer side of the first head 130 for dampening and the hinge 486 is placed against the support 122. As illustrated, the hinge 486 of the drum pillow 480 allows the drum pillow 480 to be placed around a pole, tube rod, etc., to secure the drum pillow 480 in a position for dampening.

Figure 5:
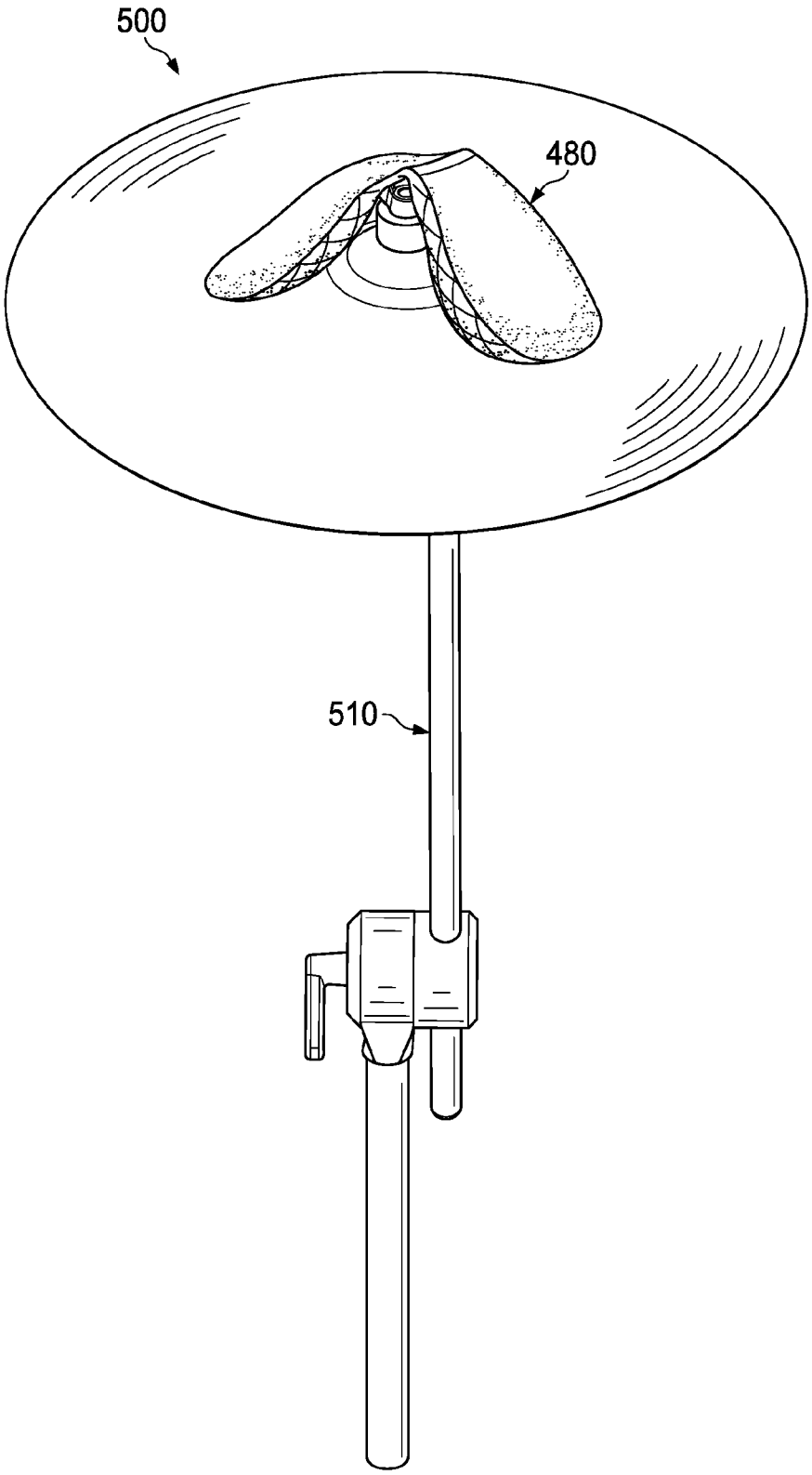
FIG. 5 illustrates another application of the drum pillow of FIG. 5 being used with a cymbal.

FIG. 5 illustrates another application of the drum pillow 480 being used with a cymbal 500. In this application, the drum pillow 480 is positioned around a pole 510 of the cymbal 500. Bottom edges of each of the weighted compartments can then rest on top of the cymbal 500 for dampening.

Figure 6:
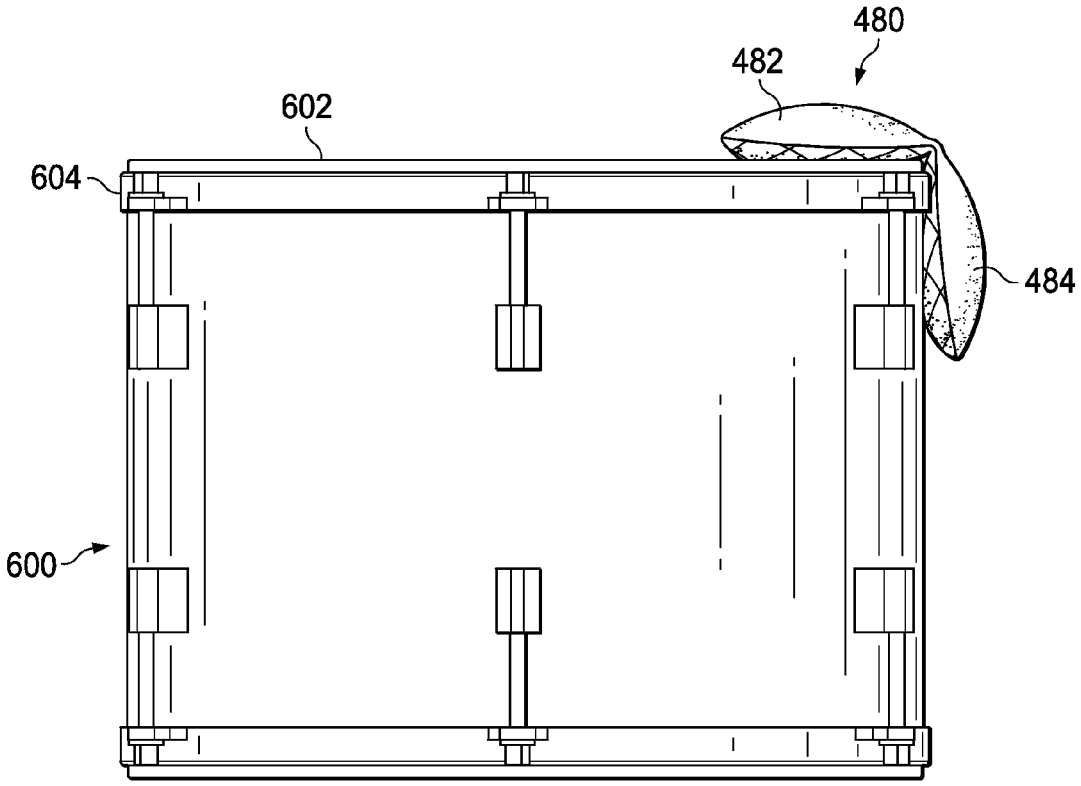
FIG. 6 illustrates a side view of another percussion instrument and the drum pillow of FIG. 4.

FIG. 6 illustrates a side view of another percussion instrument and yet another application of the drum pillow 480 being used. In FIG. 6 the percussion instrument is a drum 600 having a top head 602 and a rim 604. The drum 600 can be, for example, a snare or a tom. In FIG. 6, the weighted compartment 482 is placed on the outer surface of the top head 602, the hinge is placed on the rim 604, and the weighted compartment 484 is draped along the side of the drum 600.

Figure 7:
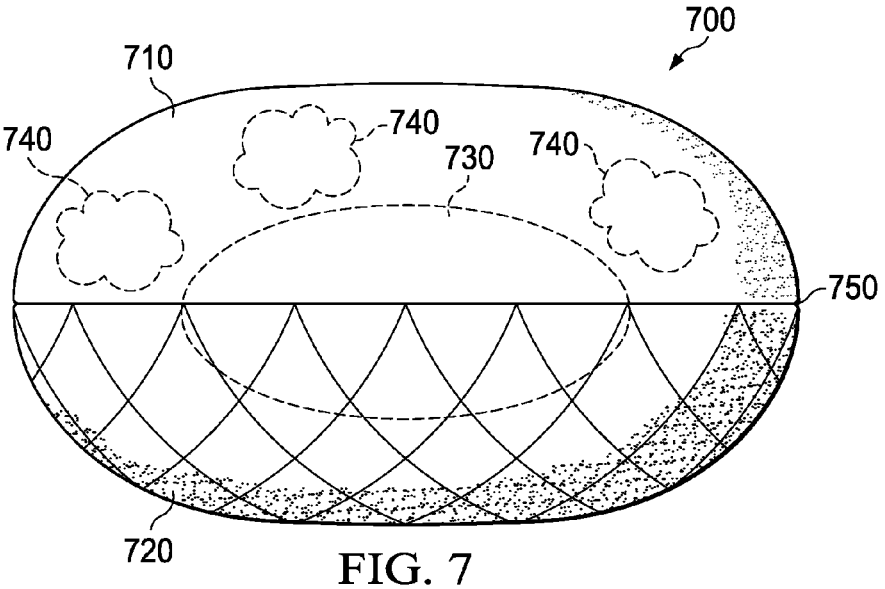
FIG. 7 illustrates a side view of an embodiment of a drum pillow constructed according to the principles of the disclosure.

FIG. 7 illustrates a side view of an embodiment of a drum pillow 700 constructed according to the principles of the disclosure. The drum pillow 700 is a non-hinged drum pillow such as the drum pillow 180. Two drum pillows such as the drum pillow 700 can be sewn together to from a hinged drum pillow such as drum pillow 480. In other embodiment, the top and bottom sides of a drum pillow can be attached together to form a hinge and two weighted compartments.

The drum pillow 700 includes a top side 710, a bottom side 720, a weighted core 730 and batting 740. The top side 710 and the bottom side 720 are joined together at a junction 750. The junction 750 can be a seam where the top side 710 and the bottom side 720 are joined together. The top side 710 and the bottom side 720 can be joined via an adhesive, thread, staples, or another chemical or mechanical means. The batting 740 is used between the weighted core 730 and the two sides, the top side 710 and the bottom side 720. For example, the batting 740 is used around the weighted core 730 to fill voids within the drum pillow 700.

The top side 710 can be constructed of an acoustic absorbing material and the bottom side 720 can be constructed of a gripping material. In one embodiment, the top side 710 is constructed of fleece and the bottom side is constructed of rubber or a rubber-like product. Inside of the drum pillow 700 is the weighted core 730. In one embodiment, the weighted core 730 includes a weighted substance inside of a flexible container that is wrapped with a fabric. In one embodiment, the weighted substance is sand, the flexible container is a plastic bag and the fabric is fleece. In some embodiments, the flexible container is essentially void of air and includes the weighted substance substantially evenly distributed therein. The flexible container can be divided into individual chambers that are separated by tape, stitching, staples, or another means to connect two sides of the flexible container together with the weighted substance located within the formed volume.

In one embodiment, the flexible container with the weighted substance is placed within the fabric, which can be a sound absorbing fabric, and these are rolled together to form the weighted core 730. The dimensions of the fabric can vary. In one embodiment, the fabric for rolling can be or proximately be 38 by 61 inches. In some embodiments, the amount of the weighted substance can be 4-5 cups. This can vary depending on the size of the drum pillow 700 and the material used, i.e., the weight or density thereof. In some embodiments, the weighted core 730 can have multiple of the weighted rolls of the flexible containers, weighted substance and fabric.

Figure 8:
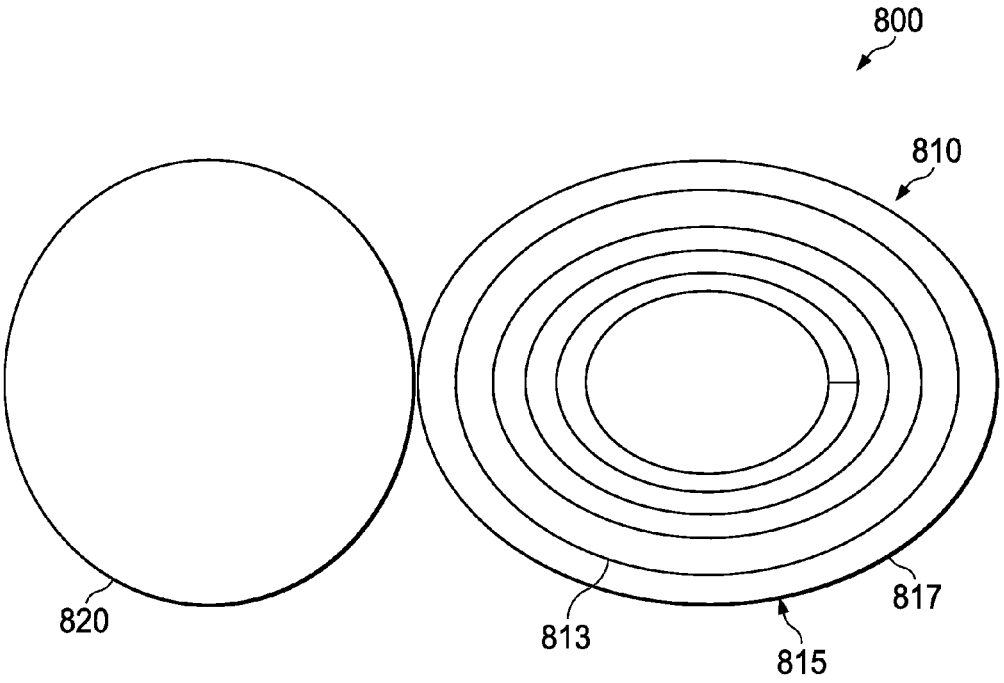
FIG. 8 illustrates a diagram of an embodiment of a weighted core constructed according to the principles of the disclosure.

FIG. 8 illustrates a diagram of an embodiment of a weighted core 800 constructed according to the principles of the disclosure. The weighted core 800 includes two weighted rolls, 810 and 820. Weighted roll 810 is provided in more detail for discussion and represents the contents of weighted roll 820. Weighted roll 810 includes weighted substance 813 within a flexible container 815 which is wrapped in a fabric 817. The fabric 817 can be fleece. In other embodiments, the fabric 817 can be another type of sound absorbing material.

The disclosure provides a self-stabilizing muffling and overtone control device for percussion instruments including bass drums. In one embodiment discussed and illustrated herein, the device or apparatus is a drum pillow that includes a weighted core, a gripping, skid resistant bottom side and a sound absorbing top side. The weighted core can be a single weighted fabric roll or have multiple weighted fabric rolls. In some embodiments, the weighted fabric rolls are the same or substantially the same size and weight. The drum pillow can also have multiple weighted compartments with each compartment having their own weighted core. The weighted cores can be as described with respect to FIG. 7 or FIG. 8.

Those skilled in the art to which this application relates will appreciate that other and further additions, deletions, substitutions and modifications may be made to the described embodiments.

The invention claimed is:

1. A drum pillow for percussion instruments, comprising:

a top side;

a bottom gripping side connected to the top side; and a weighted core fully enclosed within the connected top side and bottom side, wherein the weighted core includes a weighted roll of a weighted substance within a flexible container that is rolled in a fabric.

2. The drum pillow as recited in claim 1 wherein said bottom gripping side is constructed of a gripping material.

3. The drum pillow as recited in claim 1 wherein said top side is constructed of a sound absorbing material.

4. The drum pillow as recited in claim 1 wherein said weighted cores includes multiple weighted rolls.

5. The drum pillow as recited in claim 1 wherein said bottom gripping side is constructed of a rubber material.

6. The drum pillow as recited in claim 1 wherein said top side is constructed of a fleece material.

7. The drum pillow as recited in claim 1 wherein said fabric is fleece.

* * * * *